US010913262B2

(12) United States Patent
Veis

(10) Patent No.: US 10,913,262 B2
(45) Date of Patent: Feb. 9, 2021

(54) PRINTER INK DRYER UNITS

(71) Applicant: HP SCITEX LTD., Netanya (IL)

(72) Inventor: Alex Veis, Kadima (IL)

(73) Assignee: HP SCITEX LTD., Netanya (IL)

( * ) Notice: Subject to any disclaimer, the term of this patent is extended or adjusted under 35 U.S.C. 154(b) by 129 days.

(21) Appl. No.: 15/221,478

(22) Filed: Jul. 27, 2016

(65) Prior Publication Data

US 2017/0028707 A1 Feb. 2, 2017

(30) Foreign Application Priority Data

Jul. 31, 2015 (EP) ..... 15179369

(51) Int. Cl.

| | |
|---|---|
| ***B41F 23/04*** | (2006.01) |
| ***B41J 11/00*** | (2006.01) |
| ***B41M 7/00*** | (2006.01) |

(52) U.S. Cl.

CPC ..... *B41F 23/0486* (2013.01); *B41J 11/002* (2013.01); *B41M 7/009* (2013.01); *B41M 7/0081* (2013.01); *B41M 7/0036* (2013.01)

(58) Field of Classification Search

None

See application file for complete search history.

(56) References Cited

U.S. PATENT DOCUMENTS

| | | | |
|---|---|---|---|
| 3,052,568 | A | 9/1962 | Agruss et al. |
| 3,881,942 | A | 5/1975 | Buckwalter |
| 6,793,723 | B2 | 9/2004 | Auslander et al. |
| 6,794,117 | B2 | 9/2004 | Andrews |
| 2004/0200370 | A1 | 10/2004 | Pitz |
| 2008/0035132 | A1 | 2/2008 | Katoh |
| 2010/0034973 | A1 | 2/2010 | Ohya et al. |
| 2011/0211012 | A1 | 9/2011 | Irita |
| 2014/0132685 | A1 | 5/2014 | Amao |

FOREIGN PATENT DOCUMENTS

| | | |
|---|---|---|
| CN | 1541834 | 11/2004 |
| CN | 1727184 | 2/2006 |
| CN | 101553365 | 10/2009 |
| CN | 103998248 | 8/2014 |
| DE | 102009021634 | 11/2010 |
| JP | 2004-306598 | 11/2004 |
| JP | 2007-245374 | 9/2007 |
| JP | 2014-196497 | 10/2014 |

OTHER PUBLICATIONS

Bhargav's Blog—"Understand UV curing process in simple way"~www.graficaindia.com~13 pages~Mar. 29, 2010.

*Primary Examiner* — Joshua D Zimmerman
(74) *Attorney, Agent, or Firm* — Fabian VanCott

(57) ABSTRACT

In an example, a printer ink dryer unit comprises at least one ultraviolet light source to dry a printer ink layer by causing evaporation of a solvent fluid therefrom.

22 Claims, 3 Drawing Sheets

PRINTER INK DRYER UNITS

BACKGROUND

In print operations, liquid printing substances as inks, fixers, primers and coatings may be applied to a substrate. A substrate bearing such a substance may be dried, for example using hot air convection, infrared dryers, near infrared dryers, acoustic dryers, gas burners, Radio Frequency dryers, microwave dryers or the like.

BRIEF DESCRIPTION OF DRAWINGS

Examples will now be described, by way of non-limiting example, with reference to the accompanying drawings, in which.

DETAILED DESCRIPTION

Figure 1:
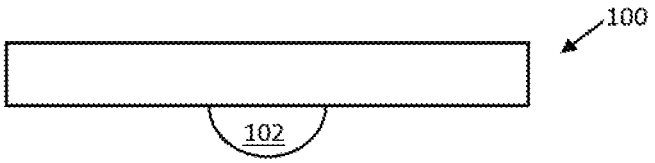
FIG. 1 is a simplified schematic of an example of printer ink dryer unit.

FIG. 1 shows a printer ink dryer unit 100 comprising at least one ultraviolet light source to evaporate solvent fluid (for example, water, glycol or the like) from a printer ink. The light source 102 may comprise an ultraviolet light emitting diode (LED), for example a 300 nm LED, a 375 nm LED, a 395 nm LED or a 410 nm LED. In other examples, the light source 102 may comprise, for example, a laser diode or other laser device. In an example, the ultraviolet light emitted from the light source 102 is associated with a higher colorant absorption efficiency than solvent absorption efficiency. The dryer unit 100 may cause evaporation of solvent fluid from a printer ink comprising at least one colorant (for example, a pigment or dye), wherein the heating of the solvent fluid (for example, water) is substantially due to heat transfer from the colorant. In some examples, the light source emits light in a relatively narrow band (for example, having a bandwidth of around 20-30 nm) in the UV range, for example having a central frequency between 200-400 nm.

Figure 2:
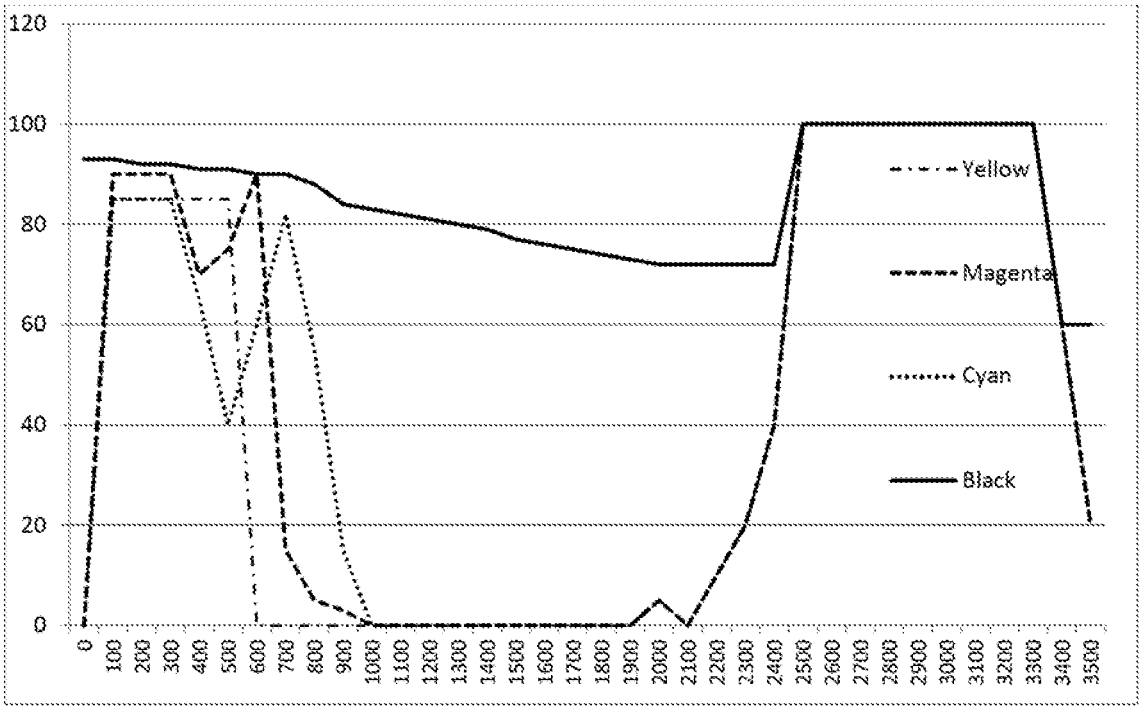
FIG. 2 shows examples of absorption efficiency for different inks irradiated by light at different wavelengths.

FIG. 2 illustrates the absorption efficiency as a percentage of the incident radiation energy for each of a yellow, magenta, cyan and black aqueous (i.e. water based) ink against wavelength of incident radiation. For all but the black ink, there are substantially two absorption zones, a first, up to around 1000 nm, where the colorant absorbs radiation with relatively high efficiency, and a second, above approximately 2200 nm, where the water component of the ink absorbs radiation (the absorption efficiencies of the yellow, magenta and cyan inks are merged at this point as the colorant is not contributing significantly to absorption). An infrared heat source in a printer ink dryer unit may for example emit radiation in the region of, for example, 600-3400 nm, with a peak at around 1200 nm. Such a heat source does not result in efficient heating of either the non-black colorants or the water, meaning the energy efficiency is low, and correspondingly the power consumed in drying processes is relatively high. For example in such a situation, cyan ink may absorb around 30% of the incident energy, while magenta and yellow inks absorb even less.

Moreover, the black ink has a markedly higher absorption efficiency than other colors overs this range, absorbing around 75%-95% of incident radiation. This imbalance can mean that a substrate underlying a black ink may overheat before, for example, a region of yellow ink on the same substrate (given that yellow ink has a colorant absorption efficiency which is low in the IR region) dries. This can cause damage to a substrate.

Figure 3:
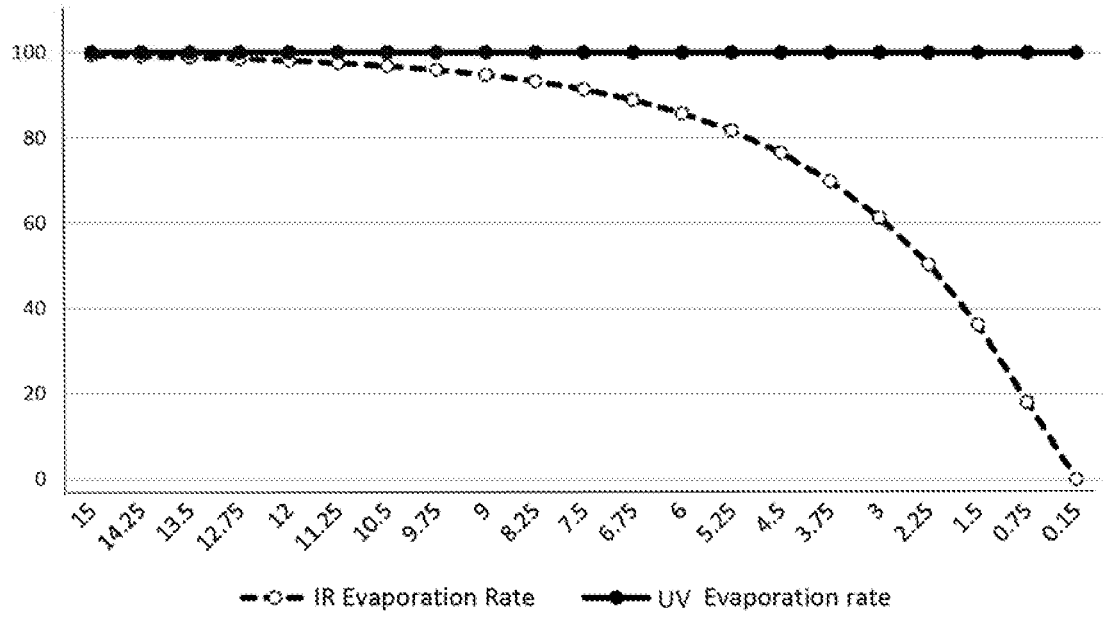
FIG. 3 shows examples of evaporation rates for ink layers irradiated by ultraviolet and Infrared light.

FIG. 3 illustrates a relationship between evaporation rates of aqueous ink for infrared (IR) drying and UV drying against ink layer thickness. As can be seen, the rates of drying using IR drop off as layer thickness decreased. This is because there is less water to absorb the radiation, as would be seen as water evaporates. During the drying process, an ink layer may initially have a thickness of around 5μ (microns) but this will reduce to 1μ or less for a dry ink layer. Since the solvent (in this example, water) absorption is a function of the layer thickness, more time and energy is needed for drying the last micron of layer thickness compared to first.

However, if, as is proposed herein, UV light is used, the energy is efficiently absorbed by the colorant, which is not evaporated, so the energy absorption, and correspondingly the evaporation rate, stays at a substantially constant level. While UV light has been used in some printing processes, for example to cause polymerisation of inks, the dose of energy supplied in such a process is low, and not at a level to cause evaporation of solvent so as to dry the ink layer. When used to cause polymerisation, a broadband source (e.g. a light source with a plurality of intensity peaks over a range of 200 nm to 1500 nm) may be employed.

Figure 4:
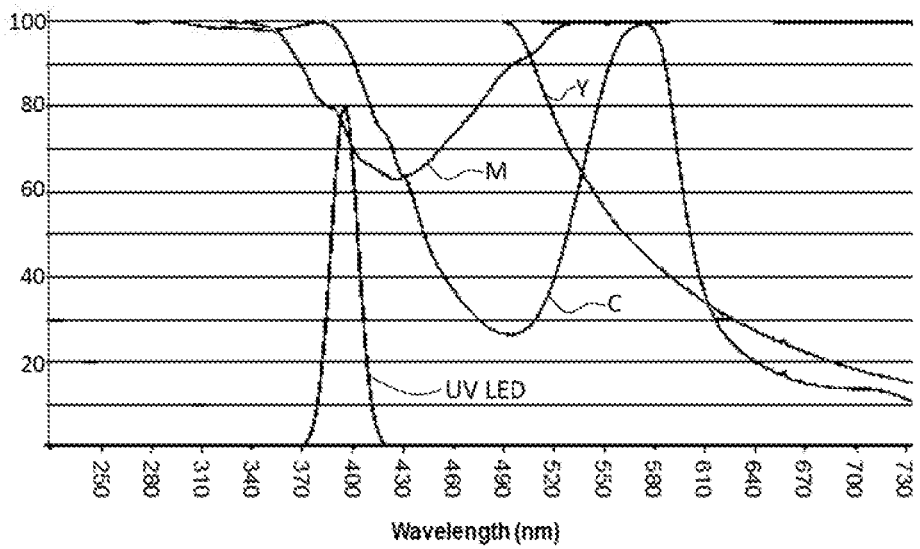
FIG. 4 shows examples of absorption efficiency or different colorants irradiated by ultraviolet light.

FIG. 4 shows the absorption spectrums of each of a layer of yellow Y, magenta M, and cyan C inks against wavelength of incident radiation which falls in the ultraviolet region of the spectrum. Black colorant has substantially 100% absorption efficiency over this range. The output intensity of an example LED, in this example a 395 nm LED, over its waveband is also shown (with an arbriatry vertical scale), labeled UV LED. A 395 nm LED is example of a readily available LED. Another such example is a 410 nm LED.

For a 395 nm LED, energy absorption efficiencies of over 90% are achieved in Cyan, Yellow and Black while Magenta absorbs energy with around 75% efficiency. Therefore, in this example the absorption efficiencies are relatively well balanced, with less than 25% separating the different colorant absorption efficiency. This means that the difference in heating of different inks is relatively small, and the inks will dry in similar timeframes, mitigating overheating which may result if inks dry over very different timeframes. In other examples, the absorption efficiencies may be within a range of 30%, 20%, 15%, 10% or 5%. In some examples, the absorption efficiencies may be within a range (i.e. sufficiently similar) such that overheating and/or damage due to overheating of a substrate underlying the ink with the highest absorption efficiency is unlikely or prevented before the ink the lowest absorption efficiency is dry.

For the sake of comparison, an ink which absorbs 30% of the incident energy (for example, as discussed above) will use 2.5 times the energy as would produce the same evaporation for an ink with a 75% absorption efficiency, resulting in additional energy consumption and associated costs, and in general more expensive and/or larger apparatus.

As the UV radiation used is relatively close to the visible range (in some examples, the waveband may be around 295-405 nm, which borders visible radiation) for any light actually incident on the substrate (which in this example is an opaque white substrate such as paper), a high percentage, for example around 95%, of non-absorbed UV light may be reflected from the substrate surface, travelling back through the ink layer, and allowing for further absorption by the ink. This may be contrasted with IR radiation, which tends to penetrate, rather than be reflected by, a substrate and may be absorbed by moisture in a porous substrate such as cardboard or paper. Use of UV therefore reduces heating to the substrate, which in turn can reduce warping in a substrate. This effect is supplemented as the absorption of UV radiation in water is low, in addition to being reflected and thereby improving efficiency of absorption, so heating of the substrate is low.

Figure 5:
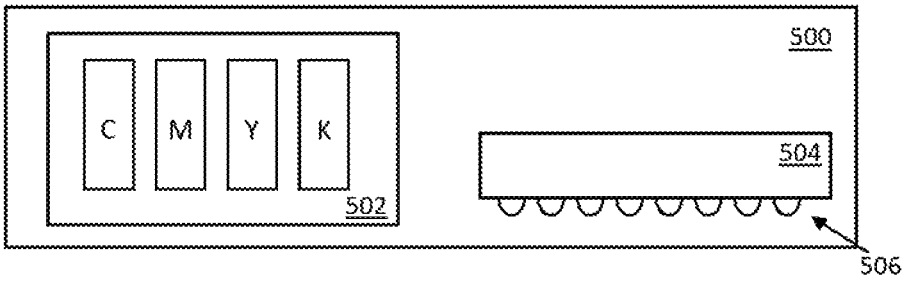
FIG. 5 is a simplified schematic of an example of print apparatus.

FIG. 5 shows an example of a print apparatus 500 comprising a printing substance distribution unit 502 and a dryer unit 504. In this example, a substrate is conveyed from a position under the printing substance distribution unit 502 to the dryer unit 504 to dry the ink, for example by a moving belt. In examples, the print apparatus 500 may be an Ink Jet printer, a xerographic printer, an offset printer, a flexo printer, a gravure printer, or any other digital or analogue printer.

The printing substance distribution unit 502 is to dispense at least one liquid printing substance comprising a colorant (e.g. a pigment or dye). In this example, the printing substance distribution unit 502 is to dispense cyan C, magenta M, yellow Y and black K colorants dissolved or suspended in water.

The dryer unit 504 in this example comprises an array 506 of ultraviolet light emitting diodes. The light emitting diodes of the array 506 are selected or controlled to emit light in a portion of the electromagnetic spectrum absorbed by colorant(s) of the printing substances CMYK, such that evaporation of water from the water-based printing substance is caused by heat transfer from the colorant(s). For example, the array 506 of light emitting diodes may comprise diodes which emit radiation in a bandwidth selected from within the wavelength range 300-450 nm. The bandwidth may be around 20 nm-30 nm.

In general, one or more light source may be selected or controlled to emit a waveband which is effective at drying the color or colors being, or to be, printed. For example, the most efficient waveband for drying colors such as Cyan, Yellow, Magenta, Green, Blue, Violet and so on, may be identified and used to control or instruct the choice of light source. In some examples, the waveband(s) of light emitted may be controlled or selected according to drying efficiency and/or providing a relatively balanced drying time for the inks applied or anticipated in a particular print operation.

In this example, the array 506 may comprise LEDs which operate to emit different wavebands and/or the wavelength of light emitted by one or more LED of the array 506 may be controllable. LEDs within the array may be selected or controlled according to a color, or combination of colors, printed or to be printed.

Figure 6:
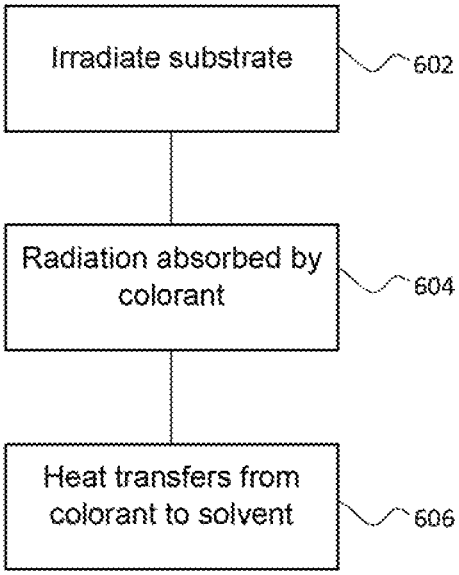
FIG. 6 is a flowchart of an example of a method of drying print substance applied to a substrate.

FIG. 6 is a flowchart of a method of drying printing substance on a substrate comprising, in block 602, irradiating a substrate bearing a solvent-based printing substance comprising a colorant with radiation to cause evaporation of solvent therefrom. The waveband of radiation is such that, in block 604, the colorant (for example, a pigment may be supplied as particles suspended in solvent) heats up. In block 606, the heat transfers from the colorant to the solvent fluid. The radiation may be chosen to provide at least a minimum absorption efficiency for a given colorant (for example, a radiation absorption efficiency of at least 70% for any or all colorants therein). For some colorants, this may mean irradiating the substrate with a waveband of radiation have a central wavelength between 200 nm to 410 nm.

The present disclosure is described with reference to flow charts and/or block diagrams of the method, devices and systems according to examples of the present disclosure. Although the flow diagram described above show a specific order of execution, the order of execution may differ from that which is depicted.

While the method, apparatus and related aspects have been described with reference to certain examples, various modifications, changes, omissions, and substitutions can be made without departing from the spirit of the present disclosure. It is intended, therefore, that the method, apparatus and related aspects be limited solely by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfill the functions of several units recited in the claims.

The features of any dependent claim may be combined with the features of any of the independent claims or other dependent claims. Features described in relation to one example may be combined with features of another example.

The invention claimed is:

1. A printer ink dryer unit comprising at least one ultraviolet light emitting diode (LED) as a light source to dry a printer ink layer by causing evaporation of a solvent fluid therefrom.

2. A printer ink dryer unit according to claim 1 to cause evaporation of solvent fluid from a printer ink comprising at least one colorant, in which the ultraviolet light emitted from the light source is associated with a higher colorant absorption efficiency than solvent absorption efficiency.

3. A printer ink dryer unit according to claim 1 in which the light source comprises an array of ultraviolet light emitting diodes.

4. A printer ink dryer unit according to claim 3, wherein the array comprises ultraviolet LEDs that emit different wavebands, the printer ink dryer unit to control selected LEDs in the array based on a waveband that is optimal for drying of a particular printing being printed.

5. A printer ink dryer unit according to claim 4, wherein the printer ink dryer unit is to selectively operate LEDs in the array that provide at least a minimum absorption efficiency for all colorants in the printing being printed.

6. A printer ink dryer unit according to claim 1 further comprising a substrate conveying system to move a printed substrate through the dryer unit, the substrate conveying system moving the printed substrate in a manner to allow for evaporation of solvent from the printer ink, wherein heating of the solvent fluid is by the at least one ultraviolet LED and predominantly due to heat transfer from a colorant in the ink.

7. A printer ink dryer unit according to claim 1 in which the light source has a bandwidth of less than 30 nm.

8. The printer ink dryer unit according to claim 1, wherein the LED has a peak wavelength of 300 nm.

9. The printer ink dryer unit according to claim 1, wherein ultraviolet light from the LED is absorbed by Cyan, Yellow, Magenta and Black pigments in the solvent fluid with a difference in absorption efficiency of less than 30%.

10. The printer ink dryer unit according to claim 1, wherein the LED emits radiation in a range of 300-450 nm with a bandwidth of 20-30 nm.

11. A printer ink dryer unit according to claim 1, further comprising a controller for the ultraviolet LED, the controller to operate the ultraviolet LED so that damage due to overheating of a substrate underlying the printer ink by a first ink with a first colorant having a highest absorption efficiency is avoided prior to a second ink with a second colorant having a lowest absorption efficiency being dried.

12. A printer ink dryer unit according to claim 1, wherein the ultraviolet LED is to provide a dose of energy so as to dry the printer ink layer, the dose of energy being greater than a dose of energy used to cause polymerization of polymerizable inks.

13. A method of operating the printer ink dryer unit of claim 1, comprising, with the printer ink dryer unit, irradiating a substrate bearing a solvent-based printing substance comprising a colorant with radiation to cause evaporation of solvent fluid therefrom, wherein a waveband of the radiation is such that heating of the solvent fluid is substantially due to heat transfer from the colorant.

14. A method according to claim 13 comprising irradiating the substrate with radiation having a radiation absorption efficiency of at least 70% for a colorant of the printing substance.

15. A method according to claim 13 comprising selecting or controlling the waveband or radiation according to the color of at least one colorant.

16. A method according to claim 13 comprising irradiating the printing substance with a waveband of radiation which is between 200 nm and 410 nm.

17. Print apparatus comprising a printing substance distribution unit and the printer ink dryer unit of claim 1, the printing substance distribution unit being to dispense a solvent-based printing substance comprising a colorant, and the dryer unit comprising at least one ultraviolet light source, the light source being to emit light in a portion of the electromagnetic spectrum absorbed by the colorant, such that evaporation of solvent fluid from the solvent-based printing substance is caused by heat transfer from the colorant.

18. Print apparatus according to claim 17 which comprises an inkjet print apparatus.

19. Print apparatus according to claim 17 in which the printing substance distribution unit is to dispense a plurality printing substances, the printing substances comprising different colors.

20. Print apparatus according to claim 19 in which the light source is to emit light in a portion of the electromagnetic spectrum which is absorbed by each of the colorants, such that the energy absorption efficiency of the colorants for the emitted light is within a range of 30%.

21. Print apparatus according to claim 17, in which the light source comprises at least one light emitting diode, the or each of the light emitting diode emitting radiation in a bandwidth from within the range 200-450 nm.

22. Print apparatus according to claim 17 in which the light source is to emit light in a portion of the electromagnetic spectrum which is absorbed by each of the colorant with a radiation absorption efficiency of at least 70%.

* * * * *